US005578160A

United States Patent [19]

Krznarich et al.

[11] Patent Number: 5,578,160

[45] Date of Patent: Nov. 26, 1996

[54] HEAT TRANSFER CONTROL SYSTEM FOR A DOUBLE BACKER

[75] Inventors: Larry M. Krznarich, Park Falls; Paul T. Melby, Phillips, both of Wis.

[73] Assignee: Marquip, Inc., Phillips, Wis.

[21] Appl. No.: 418,250

[22] Filed: Apr. 6, 1995

[51] Int. Cl.[6] ..... B31F 1/28

[52] U.S. Cl. ..... 156/462; 156/210; 156/470; 156/583.5; 156/205; 100/93 P

[58] Field of Search ..... 156/210, 420, 156/583.1, 583.3, 583.5, 583.91, 205, 471, 462; 100/93 P

[56] References Cited

U.S. PATENT DOCUMENTS 995,084 6/1911 Pacyna .
2,987,105 6/1961 Gebbie .
3,175,300 3/1965 Nitchie .
3,226,840 1/1966 Moser et al. .
4,408,520 10/1983 Wons et al. ..... 100/93 P
5,156,782 10/1992 Ballantyne ..... 100/46 X
5,183,525 2/1993 Thomas .

*Primary Examiner*—Michael W. Ball
*Assistant Examiner*—Sam Chuan Yao
*Attorney, Agent, or Firm*—Andrus, Sceales, Starke & Sawall

[57] ABSTRACT

A system for controlling the rate of heat transfer between the heating surfaces and a corrugated web in a double backer includes an air flow system operable to selectively apply a vacuum to the underside of the web via chambers formed in the spaces between the heating units or to apply pressurized air to the chambers to cool and lift the web, as necessary. A complementary system controls bowing in the surfaces of the heating units by supporting the undersides of the heating units with columns which include a thermally responsive metal member having an known coefficient of thermal expansion. The metal members are selectively heated by heating elements responsive to sensed bowing of the heating units to eliminate or minimize such bowing.

4 Claims, 2 Drawing Sheets

10
11
14
15
16
17
18
20
21
22
23
24
25
26
27
28
30
31
32
33
34
35
36
37
38
40
41
42
43
44
46
48

HEAT TRANSFER CONTROL SYSTEM FOR A DOUBLE BACKER

BACKGROUND OF THE INVENTION

The present invention relates to an apparatus for the manufacture of corrugated paperboard and, more particularly, to a heat transfer control system for a double backer in which the corrugated web is more effectively and efficiently dried and the adhesive uniformly cured.

In a typical prior art double backer (also commonly called a double facer), a single web is brought into contact with the glued flute tips of a single face corrugated web and the freshly glued double face web is passed over the surfaces of a number of serially arranged heating units, usually steam chests, to cause the starch-based glue to set. Double face web travel over the flat heated surfaces of the steam chests is provided by a wide driven holddown belt in direct contact with the upper face of the corrugated web and the top face of the belt, in turn, is held in contact with the traveling web by a series of ballast rollers or the like, all in a well known manner.

Prior art steam chests, one example of which is shown in U.S. Pat. No. 3,175,300, are typically made of heavy cast iron or steel in the manner of a pressure vessel in order to contain the high pressure steam which is supplied to heat the steam chest. For example, the walls of a cast iron steam chest are typically 1 inch (2.5 cm) or more thick to safely contain superheated steam supplied, for example, at 350° F. (177° C.) and 160 psi (1103 kPa). A steam chest heating unit typically has a flat upper web-supporting surface having a length in a transverse cross machine direction sufficient to support the full width of the traveling web. The width of the steam chest in the direction of web movement is typically about 18–24 inches (47–61 cm). Eighteen identical steam chests may typically be serially arranged in closely spaced relation in a double backer.

The heavy metal construction of steam chests results in a number of well known operational problems. The heat transfer rate from the heated surface of the steam chest to the paperboard web is maximized when intimate contact between the two is maintained. Conversely, the heat transfer rate diminishes dramatically if even air gaps as small as 0.001 inch (0.025 mm) exist. The moving corrugated web carries on its surface a laminar boundary layer of air which insulates the web from the heated surfaces of the steam chests over which the web travels through the double backer. In order to raise the rate of energy transfer to the corrugated web, various systems are known in the prior art to provide a ballast load to press the belt and corrugated web against the heated surfaces of the steam chests. These ballast systems include relatively simple roller arrangements, some of which include means for applying a variable downward force, and relatively more complex compliant weighting systems, such as inflatable air membranes. Examples of such systems are shown respectively in U.S. Pat. Nos. 5,183,525 and 5,256,240. In a typical double backer, however, the spacing between the steam chests creates a gap ranging from about ½ inch to 1 inch (about 1.25–2.5 cm) between adjacent units. This gap allows the insulating laminar boundary layer of air to effectively re-establish itself between each steam chest.

It is known in the art to place air nozzles and steam nozzles in the gaps between steam chests, as shown for example in U.S. Pat. Nos. 2,987,105 and 3,226,840. In the former patent, the air nozzles assist in cooling and lifting the corrugated web from the heated surfaces. In the latter patent, steam is applied to assist in drying the web and curing the adhesive. U.S. Pat. No. 995,084 discloses a double backer in which the corrugated web is captured between two traveling belts each made of an open-mesh wire cloth. Vacuum chambers are spaced along the surface of the hot plate system and vacuum is drawn through a foraminous plate which closes the top of each chamber to draw off air and moisture. However, the corrugated web remains spaced from the heated surfaces of the steam chests by the lower wire cloth belt.

Another problem directly affecting the efficiency of heat transfer to the web from the steam chest is the transverse bowing of the upper heating surface during operation. The temperature of the flat upper surface of the steam chest is reduced substantially relative to the bottom wall of the steam chest as a result of the cooling of the top surface from contact with the corrugated web traveling thereover. The difference in thermal expansion between the top and bottom surfaces of the steam chests produces a warp or concave bowing of the upper surface lengthwise of the steam chest (transversely across the web). Ballast systems, particularly the compliant loading systems, are intended to remove the air gap by forcing the holddown belt and paperboard web to follow the bowed contour, but in operation provide a number of disadvantages. First, drag on the holddown belt is significantly increased, which in turn causes accelerated wear of the belt. Also, the drag reduces the life of the drive system. In addition, excessive normal force on the holddown belt can result in crushing of the corrugated web and a resultant adverse effect on corrugated board quality and performance. Accelerated holddown belt wear is more pronounced on the outer edges of the belt where the belt contacts the metal heating surfaces when less than full width web is being processed.

SUMMARY OF THE INVENTION

The present invention provides a system for improving the efficiency of heat transfer from the steam chest heating units to the corrugated web by eliminating or minimizing the laminar boundary layer of air and/or eliminating or minimizing warp or bowing in the contact surfaces of the heating units. Use of the system of the present invention also eliminates or alleviates the related problems discussed above.

In a broad aspect, the apparatus of the present invention includes means in direct communication with the lower web face for drawing a vacuum in the spaces between adjacent surfaces of the heating units to diminish the laminar boundary layer of air between the web and the heated surfaces, to draw the web into intimate contact with the heated surface, and to increase the rate of heat transfer to the web; and thermally responsive means positioned in operative contact with the surfaces of the heating units for imposing a vertical upward force sufficient to effectively counter a downward bowing of the surfaces as a result of temperature differentials within the heating unit. The apparatus is particularly adapted for use with heating units which comprise enclosed chambers having generally vertically disposed front and back walls, so that the means for drawing a vacuum effectively utilizes a chamber which is defined by the front and back walls of respectively adjacent heating units. The thermally responsive means preferably comprises vertically disposed columns supporting the heating units above an underlying base, with the columns being made with a metal portion having a known coefficient of thermal expansion. Means are provided for detecting the downward bowing of the surfaces of the heating units and, in response to the detecting means, means are provided for heating the columns to cause vertical thermal expansion sufficient to prevent or minimize the bowing.

In one specific embodiment, the chambers between each heating unit are separated into serially adjacent chamber portions extending laterally across the heating units; a manifold is provided which includes a main air flow duct for each chamber and a series of air flow laterals each connecting the air flow duct with a chamber portion; means are provided for selectively applying a vacuum and pressurized air to the air flow duct; and means are provided for selectively controlling the air flow through each lateral and its respective chamber portion. More specifically, the means for applying a vacuum and pressurized air preferably comprises an induced draft blower providing a first flow connection to the air flow duct, a positive pressure blower providing a second flow connection to said air flow duct, and valve means operatively connecting the first and second flow connections to the air flow duct. A common header is provided to interconnect all air flow ducts with the vacuum and pressurized air applying means.

In another specific embodiment, the system includes a vertically disposed column which directly supports each heating unit at the lateral center thereof above a base surface; each column includes a metal portion which has a known coefficient of thermal expansion and a heater for providing controlled thermal expansion of the metal portions; downward warping or bowing of the center of the heating unit as a result of temperature differentials induced by heat loss through the upper surface is detected by a sensor; and a heater control responsive to signals from the sensor operates the heater to provide vertical thermal expansion of the metal portion sufficient to control the bowing. The system also may include means to provide rapid cooling of the heating unit. The heating unit preferably comprises an electric resistance heater and the cooling means a controlled supply of cooling water to the heating unit.

DETAILED DESCRIPTION OF THE PREFERRED EMBODIMENT

Figure 1:
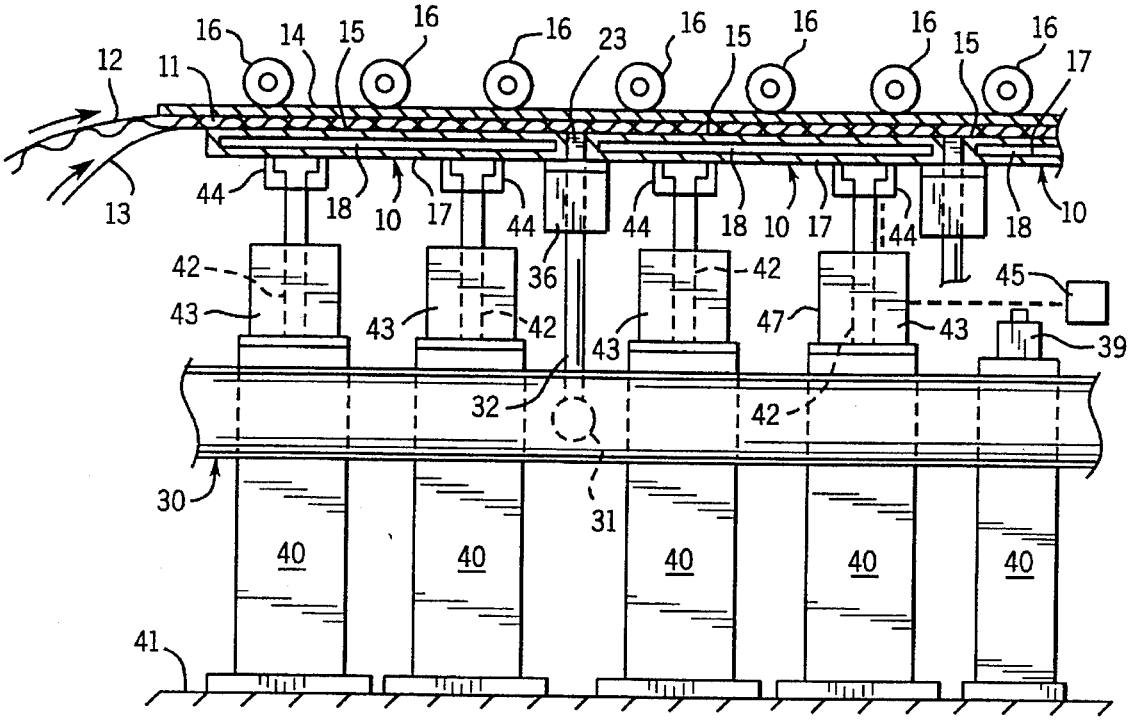
FIG. 1 is a side elevation of a portion of a double backer incorporating the system of the present invention.
Figures 2, 4:
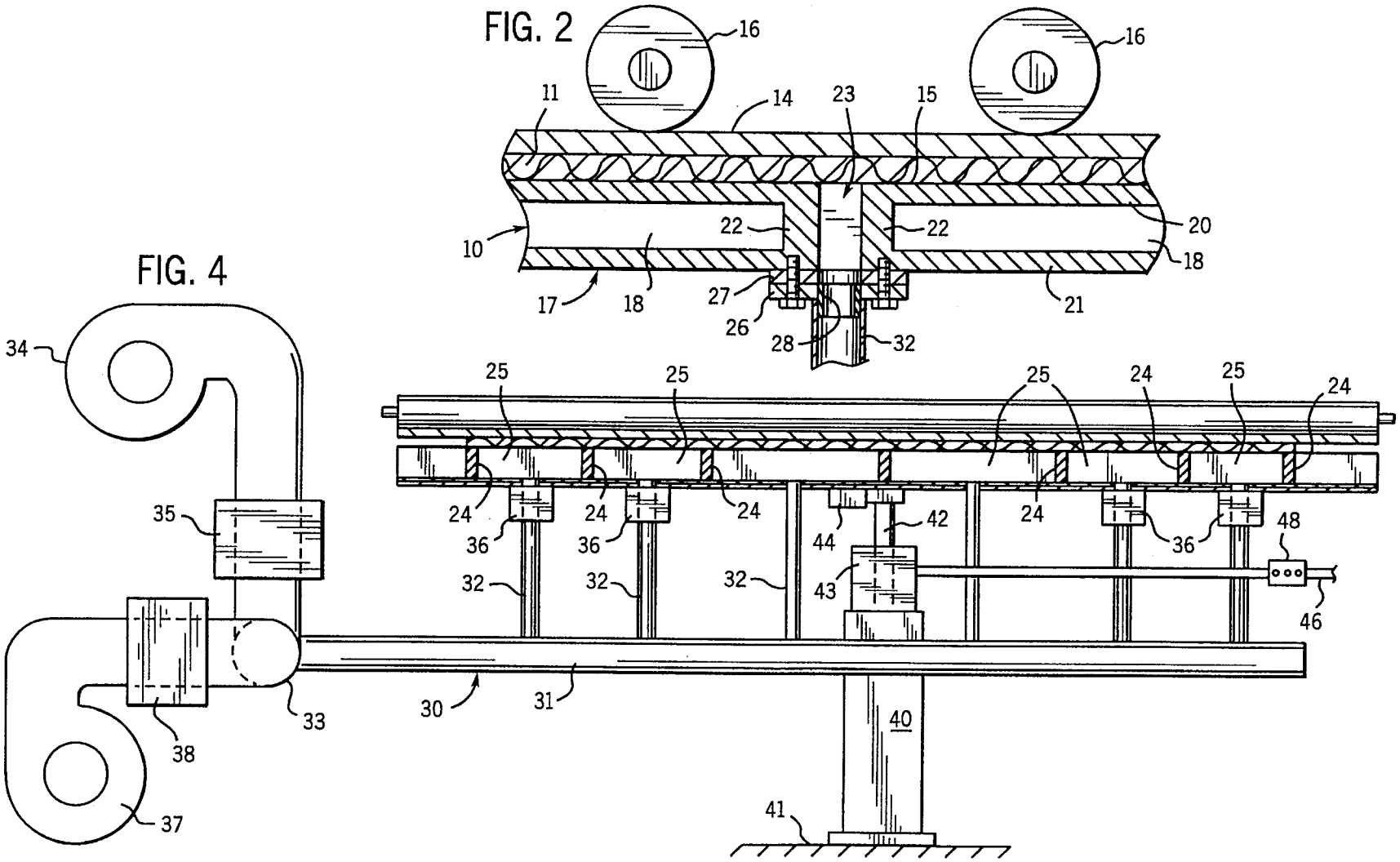
FIG. 2 is an enlarged detail of a portion of FIG. 1.
FIG. 4 is a transverse vertical section taken on line 4—4 of FIG. 3.

Referring initially to FIGS. 1 and 2, a conventional double backer includes a series of heating units 10 over which a continuous double face corrugated web 11 is moved to dry the paper components of the web and cure the starch-based adhesive used to bond the components. Typically, a single face corrugated web 12 which has previously had an adhesive applied to its exposed flute tips is brought into contact with a liner web 13 at the upstream entrance of the double backer. A driven holddown belt 14 runs over the top of the heating units 10, captures the corrugated web 11 therebetween, and pulls it over the coplanar, flat heated surfaces 15 of the heating units 10. As is also well known in the art, the force imposed on the corrugated web by the holddown belt 14 is maintained and enhanced by a series of ballast rollers 16 in rolling engagement with the upper surface of the belt. As previously indicated, other ballast load arrangements may also be used.

The heating units 10 typically comprise individual steam chests 17 which are fabricated of a heavy-walled cast iron or steel construction. Each steam chest 17 has an open interior 18 to which high pressure steam is supplied in a known manner and utilizing a supply system which is not shown in the drawings. The heavy metal upper wall of the steam chest, which defines the flat heated surface 15 over which the corrugated web 11 travels, also defines the front and rear edges of the steam chest (in the direction of web movement) and the upper ends of the adjacent end walls 22 by which the upper wall is integrally connected to a bottom wall 21 to define the open interior 18. The steam chests 17 are typically spaced apart along the double backer by a distance of about ½ to 1 inch (1.25–2.5 cm), and with the end walls 22 disposed generally vertically, adjacent steam chests define a slot or narrow chamber 23 therebetween (as may best be seen in FIG. 2). To assist in drawing the web 11 into intimate contact with the heated surfaces 15 of the steam chests, to help eliminate the laminar boundary layer of air between the web and the surfaces and, as a result, increase the rate of heat transfer to the web, the chambers 23 are sealed off and divided and a vacuum is applied directly to the chambers.

Figure 3:
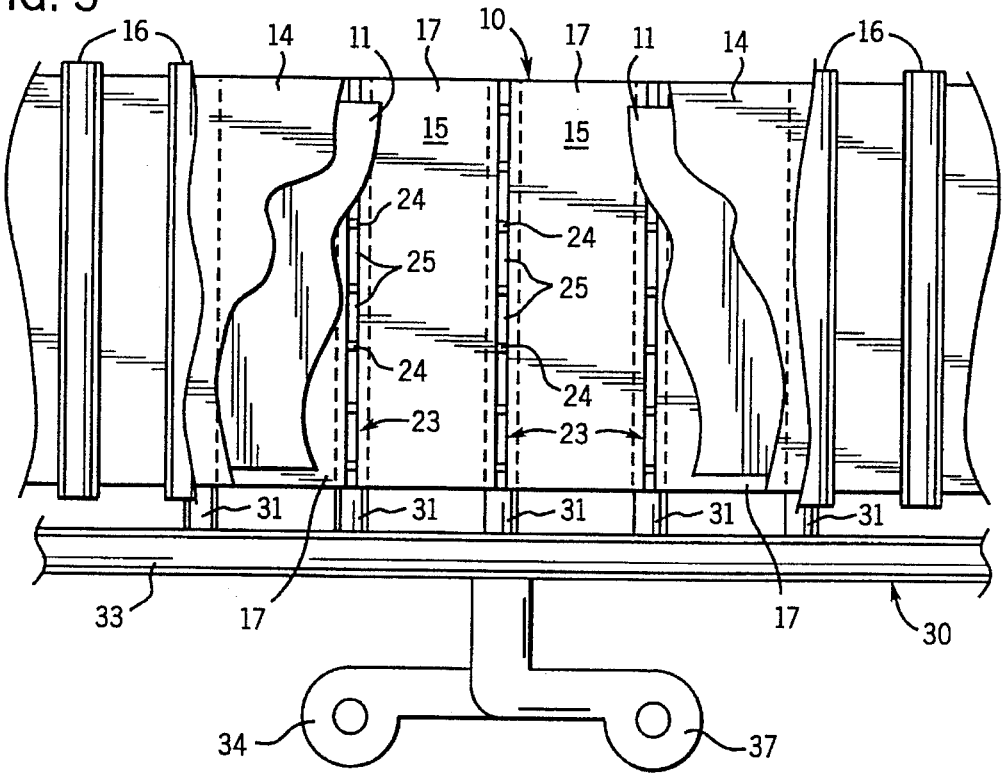
FIG. 3 is a top plan view of FIG. 1.

Referring also to FIGS. 3 and 4, each of the chambers 23 is divided into a number of subchambers or chamber portions 25 by a series of spaced separators 24. The lower open end of the chamber 23 is enclosed by a closure plate 26 bolted or otherwise fastened to the bottom wall 21 of adjacent steam chests with a suitable sealing gasket 27 positioned between the plate and the bottom walls. Each closure plate 26 includes a number of tubular sleeves 28, each of which provides open communication with one of the chamber portions 25. The number and therefore the length of the chamber portions 25 may be varied as desired, but the basic purpose is to allow selective application of the vacuum to the chamber portions 25 to provide a vacuum chamber length in the cross machine direction which is just slightly narrower than the width of the web 11. This ensures that the web provides a satisfactory upper seal for the vacuum chamber.

A vacuum/air manifold 30 includes an air flow duct 31 connected to the tubular sleeve 28 for each chamber portion 25. The opposite ends of all air flow ducts 31 for a common chamber 23 are connected to an air flow lateral 32 extending below and generally parallel to the length of the chamber in the cross machine direction. The air flow laterals 32 for each of the chambers in the double backer are likewise connected to a common header 33 alongside and extending the length of the double backer. An induced draft blower 34 is connected to the header 33 to draw a vacuum on the entire manifold 31 and to selected operative chamber portions 25 over which the web travels. A vacuum damper 35 is positioned between the blower 34 and the header 33 to modulate the air flow between full on and full off conditions. Each air flow duct 31 includes a chamber damper 36 which is also operable between full on and full off conditions to selectively control the vacuum applied to each chamber portion 25. Alternatively, the vacuum damper 35 could be replaced with a simple on-off valve, and vacuum modulation controlled by a variable speed blower motor. A non-contact web temperature sensor 39 is positioned at the downstream end of the double backer to sense the temperature of the exiting corrugated web 11. An array of such sensors 39 is preferably arranged across the width of the unit so that possible temperature variations along the width of the web in the cross machine direction can be sensed. Vacuum modulation is then controlled by sensed web temperature to increase or decrease the vacuum applied to the chamber portions 25, as may be required.

By pulling the corrugated web against the heated surfaces 15 of the steam chests, the laminar boundary layer of air is removed to allow a more efficient transfer of heat energy from the steam chests to the corrugated web. Although some type of ballast roller arrangement 16 or similar mechanical ballast load apparatus is used with the system of the present invention, excessive ballast loads may be eliminated with a consequent reduction in belt wear, drive energy consumption, and corrugated web and board damage.

Because a double backer may have to be temporarily stopped or operated at a substantially decreased speed, as a result of problems or a change in operating conditions in another part of the corrugating system, the corrugated web 11 must be lifted from the heated surfaces 15 of the steam chests in order to avoid over drying or other heat damage of the web. Although the prior art noted above includes a teaching of directing compressed air between the steam chests to the underside of the web to cool and lift the web, the system of the present invention provides for the application of cooling and lifting air simply and effectively by providing a reverse flow through the vacuum system described above. To provide the air flow, a positive pressure blower 37 is operatively connected to the common header 33 and the connecting line includes a main air flow damper 38 providing full modulation of pressurized air flow to the chambers 23 from full on to full off conditions. Modulation of pressurized air flow to the underside of the web may also be controlled by control of the individual chamber dampers 36, as previously indicated with respect to the vacuum system. As with the vacuum blower system, the air flow damper may be replaced with a valve and air flow controlled by controlling blower motor speed.

The combination of selectively applied vacuum and pressurized air allows precise control of the heating of the corrugated web 11 in a manner which improves heat transfer efficiency and rapid reduction in heat transfer, as necessary. Control of the pressurized air system to lift and cool the board may, of course, be coordinated with variable load control on the ballast rollers 16 to, for example, cause the rollers to be lifted from the belt when cooling is desired.

As discussed above, the thermal warp or bowing of the flat heated surfaces 15 of the steam chests, because of temperature differentials, not only has direct adverse affects on adhesive curing and board quality, but if not controlled or adequately compensated for will also adversely affect the beneficial results attained from the vacuum system previously described. Because of the inherent lower temperature of the steam chest upper wall 20 and its flat upper surface 15, the entire steam chest tends to bow downwardly in operation such that the upper surfaces 15 develop a concavity when viewed in lateral cross section and the bottom walls correspondingly become convex. The system of the present invention provides thermally responsive means to impose a vertical upward force on the underside of each steam chest to counteract the downward bowing or warp.

In the embodiment shown, a pair of support columns 40 are provided for each steam chest 17. The columns extend between a lower support base surface and the bottom wall 21 of the steam chest and are preferably aligned on the centerline of the double backer in the direction of web movement. Each column includes a metal portion 42 having a known coefficient of thermal expansion. This portion is surrounded by a heating device 43 such as an electric resistance heater. An appropriate sensor 44, such as a linear displacement transducer, is positioned adjacent the upper end of the column 40 and the bottom wall 21 of the steam chest and is responsive to downward displacement of the steam chest as a result of bowing. A heater control 45 is responsive to a displacement signal from the sensor 44 to operate the heating device 43 and provide vertical thermal expansion of the metal portion 42 of the column to prevent or control bowing of the steam chest. The use of an appropriate displacement transducer in the sensor 44 can provide signals directly proportional to the amount of steam chest displacement and, correspondingly, can be used to provide proportional control via the heater control 45 as needed. Due to changing conditions in the operation of the double backer, it may be desirable or necessary to provide rapid cooling and contraction of the thermally responsive metal portion 42. To provide this cooling, water may be supplied via a supply line 46 to a cooling jacket 47 on each heating device 43. The water line 46 may include an appropriate flow control 48 also responsive to signals from the sensors 44.

We claim:

1. In a double backer apparatus for curing the adhesive in a double face corrugated paper web, said apparatus including a series of heating units comprising closed metal chambers supplied with a heated fluid medium and having heated upper surfaces disposed in a common plane and over which the corrugated paper web is moved with its lower face in direct contact, said heating units disposed in closely spaced relation to define, between adjacent units, chambers in open communication with the underside of the web, a system for controlling the rate of heat transfer between the heated surfaces and the lower web face comprising:

a vertically disposed column directly supporting each heating unit at the center thereof above a base surface;

each column including a metal portion having a known coefficient of thermal expansion and a heater for providing controlled thermal expansion of said metal portion;

a sensor for detecting downward bowing of the center of each heating unit as a result of temperature differentials in the unit from heat loss through the upper surface; and, a heater control responsive to a signal from said sensor to operate the heater and provide vertical thermal expansion of said metal portion sufficient to control said bowing.

2. The system as set forth in claim 1 including means for providing rapid cooling of the heating unit.

3. The system as set forth in claim 2 wherein said heating unit comprises an electric resistance heater and said cooling means comprises a controlled supply of cooling water to said heating unit.

4. An apparatus for improving the heat transfer efficiency in a double backer for a corrugated web, which double backer is of the type having a series of metal heating units with flat heated surfaces aligned in closely spaced relation in the direction of web movement and over which the web is moved and held in contact by an upper holddown device in direct contact with the upper face of the web, said apparatus comprising:

means in direct communication with the lower web face for drawing a vacuum in the spaces between adjacent heated surfaces to diminish the laminar boundary layer of air between the lower web face and said surfaces, to draw the web into intimate contact with the heated surface, and to increase the rate of heat transfer to the web; and, thermally responsive means including vertically disposed columns supporting the heating units above an underlying base, said columns being made with a metal portion having a known coefficient of thermal expansion, means for detecting the downward bowing of said heated surfaces, and means responsive to said detecting means for heating the columns to cause vertical thermal expansion thereof and a vertical upward force sufficient to effectively counter a downward bowing of said surfaces resulting from temperature differential within each of said heating units.

* * * * *